United States Patent [19]

Schibbye et al.

[11] Patent Number: 4,611,976

[45] Date of Patent: Sep. 16, 1986

[54] CAPACITY AND INTERNAL COMPRESSION CONTROL DEVICE IN A SCREW COMPRESSOR

[75] Inventors: (Lars) Laurtiz B. Schibbye, Saltsjö-Duvnäs; Rolf A. Englund, Spånga, both of Sweden

[73] Assignee: Sullair Technology AB, Sweden

[21] Appl. No.: 489,789

[22] Filed: Apr. 29, 1983

[30] Foreign Application Priority Data

Apr. 30, 1982 [SE] Sweden ..... 8202735

[51] Int. Cl.[4] ..... F01C 18/00

[52] U.S. Cl. ..... 418/159; 418/201

[58] Field of Search ..... 418/159, 201, 203; 417/310, 440

[56] References Cited

U.S. PATENT DOCUMENTS 4,032,310 8/1977 Schibbye ..... 418/201

FOREIGN PATENT DOCUMENTS 959831 6/1964 United Kingdom ..... 418/159

2076896 12/1981 United Kingdom ..... 418/201

OTHER PUBLICATIONS

Shaw, "Proceedings of the DOE Heat Pump Contractors' Program Integration Meeting", U.S. Department of Energy (Aug. 1982).

*Primary Examiner*—Leonard E. Smith
*Assistant Examiner*—Jane E. Obee
*Attorney, Agent, or Firm*—Wood, Dalton, Phillips, Mason & Rowe

[57] ABSTRACT

The invention relates to a device for controlling a screw compressor, in which a rotor housing (10) includes a compression space (15) with two intermeshing rotors. In parallel with the rotors, at their discharge side two axially movable sliding valves (20, 21) are located, viz. one inner (20) and one outer sliding valve (21). The inner sliding valve (20) is movable in the outer sliding valve (21). One of the sliding valves is arranged for controlling the internal compression in the compression space (15), while the second sliding valve is arranged for controlling the capacity of the compressor.

6 Claims, 2 Drawing Figures

CAPACITY AND INTERNAL COMPRESSION CONTROL DEVICE IN A SCREW COMPRESSOR

This invention relates to a structural design for screw compressors, by which the capacity and the internal compression of the compressor are controlled independently of each other.

Conventional structural designs for screw compressor control all have shown the limitation, that the capacity control and internal compression control either were bound to each other, in most cases in a way unfavourable from an efficiency aspect as shown, for example, in U.S. Pat. No. 3 314 597, or were not bound to each other, but that the capacity was then controlled in steps, as shown in the patent application SE No. 8202734-3.

The present invention, however, renders possible a control, at which the capacity and the internal compression each can be varied continuously and, besides, independently of each other and where said latter possibility, viz. continuous control of the internal compression to an optimal value for any operation condition, implies that optimum efficiency in the compressor can be obtained, irrespective of the capacity or pressure at which the compressor is operating. This is a great step forward to the commercial utilization of screw compressors, especially in new application fields, because an efficient and continuous control of the internal compression at varying operation conditions, viz, at different inlet and outlet pressures, and different capacities is very strongly desired in order to improve the competitiveness from efficiency point of view especially with reciprocating compressors.

Especially in refrigeration applications, for example for heat pumps, the working conditions in operation vary considerably, and the requirements on optimum efficiency at all prevailing inlet and outlet pressures as well as within the entire part load range are very high.

Figure 1:
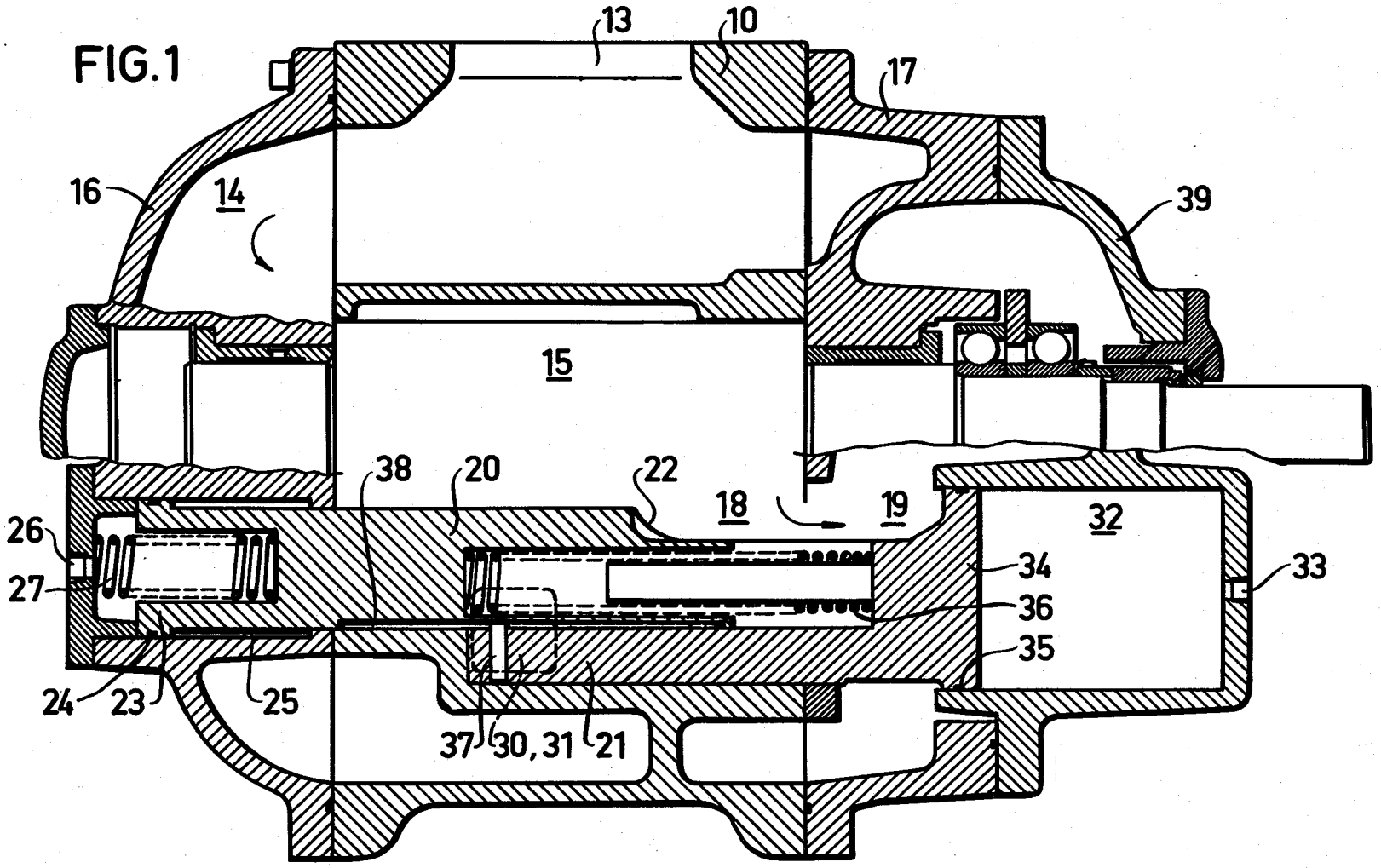
Figure 2:
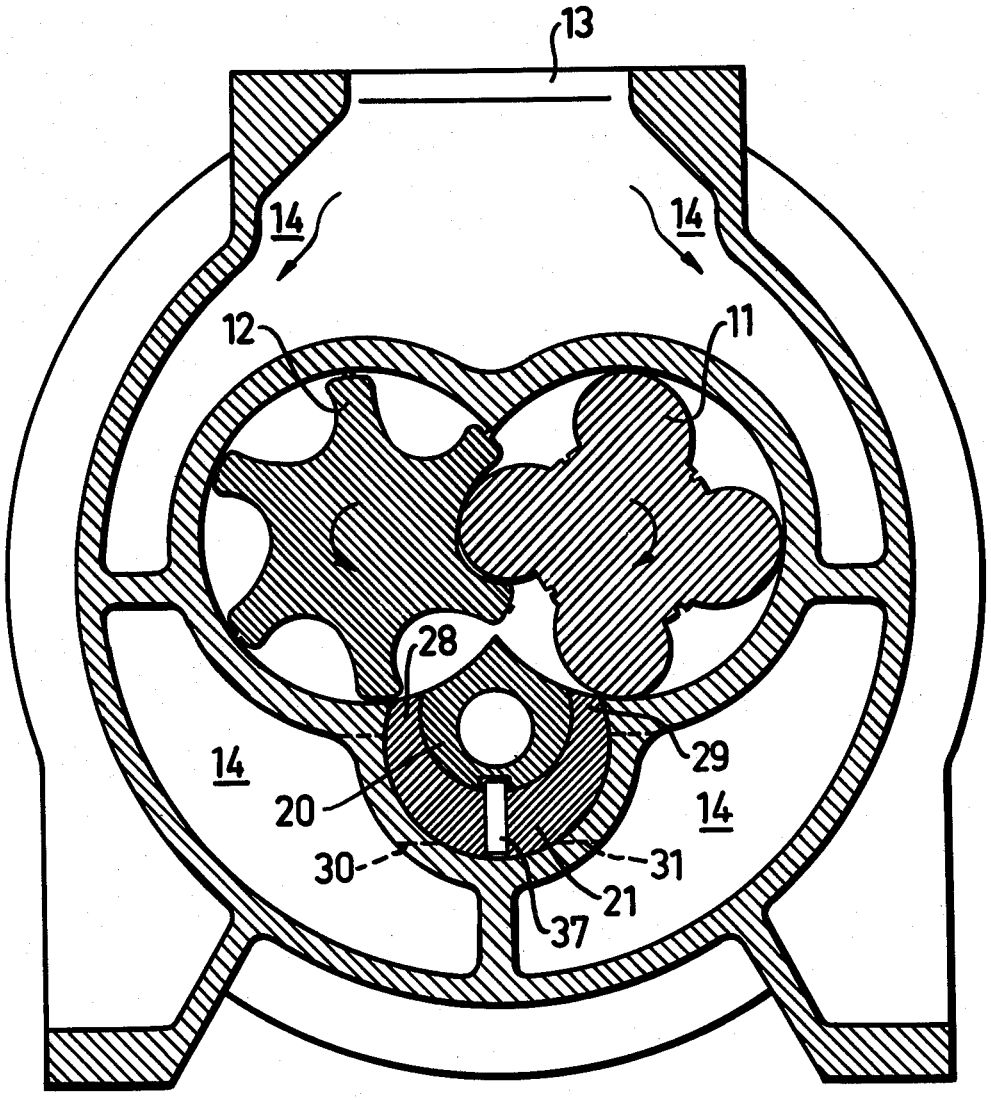

The invention is described in greater detail by way of an embodiment shown in the accompanying drawings, in which FIG. 1 is a longitudinal section through an oil-injected screw compressor, and FIG. 2 is a cross-section through the compressor shown in FIG. 1.

In FIGS. 1 and 2, thus, an oil-injected screw compressor is shown by way of a longitudinal section and a cross-section, respectively comprising a compressor housing 10 with two intermeshing rotors 11 and 12.

Upwardly in the Figures, the inlet flange connection 13 of the compressor is located which communicates with the inlet channel 14 connected to the axial inlet port (not shown) to the compression space 15. An inlet housing 16 and a discharge housing 17 are flanged to the compressor housing 10. In said discharge housing 17 the discharge gas flows out from the compression space 15 in a discharge channel 19 via the discharge port 18 to a discharge flange connection (not shown).

In the compressor two axially movable sliding valves 20 and 21 are located, of which the valve 20 is mounted slidably in the valve 21. The function of the valve 20 is to continuously control the internal compression in the compressor so that the radial opening edge 22 of the discharge port 18 of the compressor is moved axially, thereby changing the size of that volume which is enclosed in a thread pair separated from the inlet and discharge ports of the compressor, and which is just going to be put in communication with the discharge by means of the radial edge 22.

A control force from a piston 23, which comprises a sealing 24 and is actuated by pressure oil, acts on the valve 20. The piston moves sealingly along a cylinder surface 25 located in the inlet housing 16, and the pressure oil is supplied through a connection 26. A compression spring 27 is provided which effects the valves 20 and 21 at the start of the compressor to the outermost position of the valve 21 to the right in FIG. 1.

The sliding valve 21 has the function of continuously controlling the capacity of the compressor, i.e. the gas volume sucked in through the inlet connection 13. The axial position of the valve 21 shown in FIG. 1 is the position of maximum compressor capacity. When moving the valve 21 to the right in FIG. 1, bleed off passageways 28, 29 from the compression space 15 are obtained, so that part of the gas sucked in through the inlet channel 14 into said compression space is returned to the inlet passageway channel 14 via ports 30, 31, thereby reducing the compressor capacity. The control force on the valve 21 is obtained in that pressure oil is supplied to a hydraulic cylinder 32 via a connection 33, whereby said pressure oil actuates a piston 34, which is provided with a sealing 35. For unloading the valve 21 prior to the start of the compressor, a compression spring 36 is provided which in co-operation with the compression spring 27 has the object to move said valve 21 to its outermost position to the right in FIG. 1. By said compression spring 27, also the valve 20 prior to the start of the compressor is moved to its outermost position to the right in FIG. 1.

It appears from the embodiment exemplifying the invention in FIGS. 1 and 2, that a continuous control of both the internal compression and capacity of the compressor has been obtained, and that these two control functions are controlled independently of each other. The adjusting of the valve 20 is controlled by impulses from the pressure prevailing in the inlet and outlet of the compressor, or in the way disclosed basically in patent application SE No. 8202734-3. There exists several possibilities of designing such control systems which can be applied also in this case.

The adjusting of the valve 21 can be controlled in different ways, depending on the application system in which the compressor operates. It may be the demand of refrigeration capacity in a refrigeration installation, the discharge pressure in a compressed-air installation, etc. For locking the valve 21 in respect of rotation, guides (not shown) are provided in the discharge housing 17, while the valve 20 in respect of rotation is locked by means of a pin 37 extending in a groove 38 in the valve 20.

A further object of said pin 37 is to ensure a certain relative movement between the valves so as to provide a suitable control length in both directions of the inner valve 20 in relation to the outer valve 21.

What we claim is:

1. A device for controlling an oil injected screw compressor, in which a rotor housing having an inlet end and a discharge side includes a compression space with two intermeshing rotors and in parallel with the rotors along the discharge side of the rotor housing two axially movable sliding valves, viz. one inner and one outer sliding valve and is arranged for controlling the internal compression in the compression space, and the outer sliding valve is arranged for controlling the capacity of the compressor, characterized in that a cylinder is positioned in the housing inlet end and has a piston on one end of the inner sliding valve slidably received therein, said cylinder being connected to an oil supply at a pressure substantially equal to pressure at the compressor discharge side to actuate the piston on its side remote from the compression space, and said outer sliding valve being actuated by a compression spring for moving the outer sliding valve to its entirely unloaded position when the compressor is not in operation, said compression spring having one end on the outer sliding valve and the other end on the inner sliding valve.

2. A device as defined in claim 1, characterized in that a second compression spring biases the inner sliding valve piston outwardly from its associated cylinder.

3. A device for controlling an oil injected screw compressor comprising an inlet housing with an inlet channel, a rotor housing including a compression space with two intermeshing rotors, a discharge housing with a discharge channel, an end cover connected to the discharge housing, and in parallel with the rotors along the discharge side of the rotor housing two axially movable sliding valves, viz. one inner and one outer sliding valve of which the inner sliding valve is axially movable in the outer sliding valve and is arranged for controlling the internal compression in the compression space and the outer sliding valve is arranged for controlling the capacity of the compressor, characterized in that one end of the inner sliding valve extends into said inlet housing of the compressor and has a piston slidably movable in a cylinder positioned in said inlet housing, said cylinder being connected to an oil supply having an oil pressure substantially equal to the pressure in said discharge channel to actuate the piston on its side remote from the compression space, that the outer sliding valve extends with one end in the discharge housing and end cover, said one end of the outer sliding valve having a piston moving in a cylinder positioned in the discharge housing and end cover, for axial adjustment of the outer sliding valve, said piston on its side remote from the compression space being actuated by a pressure oil having a pressure substantially equal to the discharge pressure of the compressor.

4. A device as defined in claim 3, characterized in that the outer sliding valve is actuated by a compression spring for moving the outer sliding valve to its entirely unloaded position when the compressor is not in operation.

5. A device as defined in claim 4, characterized in that the compression spring has one end on the outer sliding valve and the other end on the inner sliding valve.

6. A device as defined in claim 5, characterized in that a second compression spring biases the inner sliding valve piston outwardly from its associated cylinder.

* * * * *